US005974802A

United States Patent [19]

Blake

[11] Patent Number: 5,974,802

[45] Date of Patent: Nov. 2, 1999

[54] EXHAUST GAS RECIRCULATION SYSTEM EMPLOYING A FLUIDIC PUMP

[75] Inventor: James Edward Blake, Rancho Palos Verdes, Calif.

[73] Assignee: AlliedSignal Inc., Morristown, N.J.

[21] Appl. No.: 09/009,468

[22] Filed: Jan. 20, 1998

Related U.S. Application Data

[60] Provisional application No. 60/036,040, Jan. 27, 1997.

[51] Int. Cl.[6] ..... F02B 29/04; F02B 33/34; F02M 25/07

[52] U.S. Cl. ..... 60/605.2; 60/599; 123/568.12; 123/568.15

[58] Field of Search ..... 123/568.11, 568.12, 123/568.15, 568.17; 60/605.2, 609, 278, 599

[56] References Cited

U.S. PATENT DOCUMENTS

| | | | |
|---|---|---|---|
| 3,292,364 | 12/1966 | Cazier | 60/605.1 |
| 3,303,994 | 2/1967 | Morooka | 417/369 |
| 3,383,092 | 5/1968 | Cazier | 415/186 |
| 3,423,926 | 1/1969 | Nancarrow et al. | 60/615 |
| 3,589,383 | 6/1971 | Garnier | 137/806 |
| 3,599,431 | 8/1971 | Fonda-Bonardi | 60/645 |
| 3,648,800 | 3/1972 | Hoerst | 181/213 |
| 3,685,614 | 8/1972 | Coanda et al. | 181/256 |
| 3,739,984 | 6/1973 | Tontini | 239/265.17 |
| 3,798,906 | 3/1974 | Woollenweber | 60/598 |
| 3,806,063 | 4/1974 | Fitzgerald | 244/3.22 |
| 3,875,745 | 4/1975 | Franklin | 60/319 |
| 3,877,447 | 4/1975 | Ross, Sr. | 60/278 |
| 4,231,225 | 11/1980 | Aya | 60/612 |
| 4,250,711 | 2/1981 | Zehnder | 60/605.2 |
| 4,276,865 | 7/1981 | Hamai | 123/275 |
| 4,350,013 | 9/1982 | Yoshiba | 60/605.2 |
| 4,413,593 | 11/1983 | Resler, Jr. | 123/430 |
| 4,426,848 | 1/1984 | Stachowicz | 60/605.2 |
| 4,489,702 | 12/1984 | Cholvin et al. | 123/564 |
| 4,513,730 | 4/1985 | Cholvin et al. | 123/564 |
| 4,515,136 | 5/1985 | Cholvin et al. | 123/564 |
| 4,555,904 | 12/1985 | Melzer et al. | 60/605.2 |
| 4,653,275 | 3/1987 | Sumser et al. | 60/602 |
| 4,738,548 | 4/1988 | Zloch et al. | 384/99 |
| 4,833,887 | 5/1989 | Kawamura et al. | 60/608 |
| 4,925,463 | 5/1990 | Kuhnert | 55/284 |
| 4,969,328 | 11/1990 | Kammel | 60/275 |
| 4,993,452 | 2/1991 | Hough | 137/515.7 |
| 5,014,509 | 5/1991 | Broering et al. | 60/274 |
| 5,052,178 | 10/1991 | Clerc et al. | 60/274 |

(List continued on next page.)

FOREIGN PATENT DOCUMENTS

| | | |
|---|---|---|
| 0 732 490 A2 | 9/1996 | European Pat. Off. . |
| 0 740 065 A1 | 10/1996 | European Pat. Off. . |
| 42 31 218 C1 | 9/1993 | Germany . |
| 196 07 538 A1 | 8/1996 | Germany . |
| WO 94/29587 | 12/1994 | WIPO . |
| WO 96/18030 | 6/1996 | WIPO . |

*Primary Examiner*—Willis R. Wolfe
*Attorney, Agent, or Firm*—Felix L. Fischer

[57] ABSTRACT

Efficient Exhaust Gas Recirculation (EGR) for use with internal combustion engines is provided by a system including a fluidic pump, such as a Coanda effect pump. The fluidic pump has a primary air inlet receiving pressurized air from a source such as the pressure tank of a truck air brake system which operates at a pressure sufficient to provide high energy air. The pumped fluid inlet is connected to the exhaust gas manifold to receive the exhaust gas for recirculation and the outlet of the fluidic pump is connected to the inlet manifold of the engine downstream of the charge air boosting system.

10 Claims, 3 Drawing Sheets

U.S. PATENT DOCUMENTS 5,065,576 11/1991 Kanazawa et al. ..... 60/295
5,067,319 11/1991 Moser ..... 60/288
5,069,036 12/1991 Schorn et al. ..... 60/323
5,079,917 1/1992 Henkel ..... 60/274
5,113,652 5/1992 Baines et al. ..... 60/288
5,195,318 3/1993 Shinzawa et al. ..... 60/285
5,203,311 4/1993 Hitomi et al. ..... 123/568.12
5,211,010 5/1993 Hirota ..... 60/280
5,232,793 8/1993 Miyauchi et al. ..... 429/16
5,327,725 7/1994 Mitsubori ..... 60/605.2
5,333,456 8/1994 Bollinger ..... 60/605.2
5,406,796 4/1995 Hiereth et al. ..... 60/605.2
5,425,239 6/1995 Gobert ..... 60/605.2
5,426,936 6/1995 Levendis et al. ..... 60/278
5,440,880 8/1995 Ceynow et al. ..... 60/605.2
5,443,547 8/1995 Morikawa ..... 60/274
5,456,240 10/1995 Kanesaka ..... 123/565
5,533,487 7/1996 Cailey ..... 123/568.17
5,546,914 8/1996 Scheinert ..... 123/568.14
5,607,010 3/1997 Schönfeld et al. ..... 165/51
5,611,202 3/1997 Sumser et al. ..... 60/605.2
5,611,203 3/1997 Henderson et al. ..... 60/605.2
5,611,204 3/1997 Radovanovic et al. ..... 60/605.2
5,617,726 4/1997 Sheridan ..... 60/605.2
5,632,258 5/1997 Tsuzuki et al. ..... 123/568.26
5,657,630 8/1997 Kjemtrup et al. ..... 60/605.2
5,669,365 9/1997 Gärtner et al. ..... 123/568.12
5,671,600 9/1997 Pischinger et al. ..... 60/605.2
5,682,746 11/1997 von Hoerner ..... 60/605.2
5,697,211 12/1997 Kawaguchi ..... 60/39.512
5,701,874 12/1997 Sari et al. ..... 123/568.26
5,791,146 8/1998 Dungner ..... 60/605.2

EXHAUST GAS RECIRCULATION SYSTEM EMPLOYING A FLUIDIC PUMP

This application claims benefit of U.S. Provisional Application Ser. No. 60/036,040 filed Jan. 27, 1997.

BACKGROUND OF THE INVENTION

1. Field of the Invention

The present invention is related generally to the field of internal combustion engine exhaust gas recirculation (EGR) for emissions improvement. More particularly, the invention provides an EGR system employing a fluidic pump receiving high energy primary air from a secondary pressure source for pumping of recirculated exhaust gas.

2. Description of the Related Art

EGR is a known method for reducing the NOX emissions in internal combustion engines. For effective use, an EGR system must overcome the adverse pressure gradient created by a positive pressure gradient across the engine. Various approaches to implementing EGR have included pumping of a portion of the exhaust gas from the exhaust manifold to the intake manifold. Pumping has been accomplished by introducing the exhaust gas into the compression inlet of a conventional turbocharger or supercharger present on the engine or, alternatively, providing a separate compressor receiving the exhaust gas and pressurizing it to a suitable pressure for insertion into the charge air downstream of the charge air boosting system on the engine.

Exhaust gases typically are corrosive or abrasive reducing desirability of introducing recirculated exhaust gas into the normal charge air boosting system due to damage or fouling of compressor or cooler components. Employing a separate compressor allows special configuration of the component to withstand the exhaust gas effects, however, such devices tend to be relatively expensive and reliability remains an issue.

Alternative designs for EGR incorporate fluidic pumping devices for obtaining pressurization of the recirculated exhaust gas flow. Use of the dynamic head of the exhaust gas stream for primary flow in such devices has typically been employed. The limited energy differential available for pressure amplification of the exhaust gas to be recirculated limits the effective capability of such devices. However, fluidic pumping avoids the cost and complexity of mechanical compression and components for such designs can be designed for robust tolerance to the exhaust gas effects.

It is therefore, desirable to provide a fluidic pumping system for EGR which incorporates a primary pumping gas flow with sufficient energy to provide the desired pressure amplification at flow rates sufficient to achieve recirculation of the exhaust gas at practical levels downstream of charge air boosting systems on the engine to avoid contamination of those systems.

SUMMARY OF THE INVENTION

The present invention provides an EGR system, for use with internal combustion engines, which incorporates a fluidic pump employing the Coanda effect, in the embodiments disclosed herein. The fluidic pump has a primary air inlet receiving pressurized air from a source such as the pressure tank of a truck air brake system which operates at a pressure sufficient to provide high energy air. The pumped fluid inlet is connected to the exhaust gas manifold to receive the exhaust gas for recirculation and the outlet of the fluidic pump is connected to the inlet manifold of the engine downstream of the charge air boosting system.

In one embodiment, a pressure reservoir is connected, through an outlet conduit incorporating a controllable valve, to the primary air inlet of the fluidic pump. The controllable valve comprises a demand type valve or an electronically controlled valve to properly meter primary air flow for the desired flow volume and pressure in the pump. Alternatively, the primary air inlet of the pump incorporates a movable element for integration of the valve into the pump.

For enhanced performance, an EGR cooler is provided prior to the engine inlet manifold connection for the recirculated exhaust gas.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
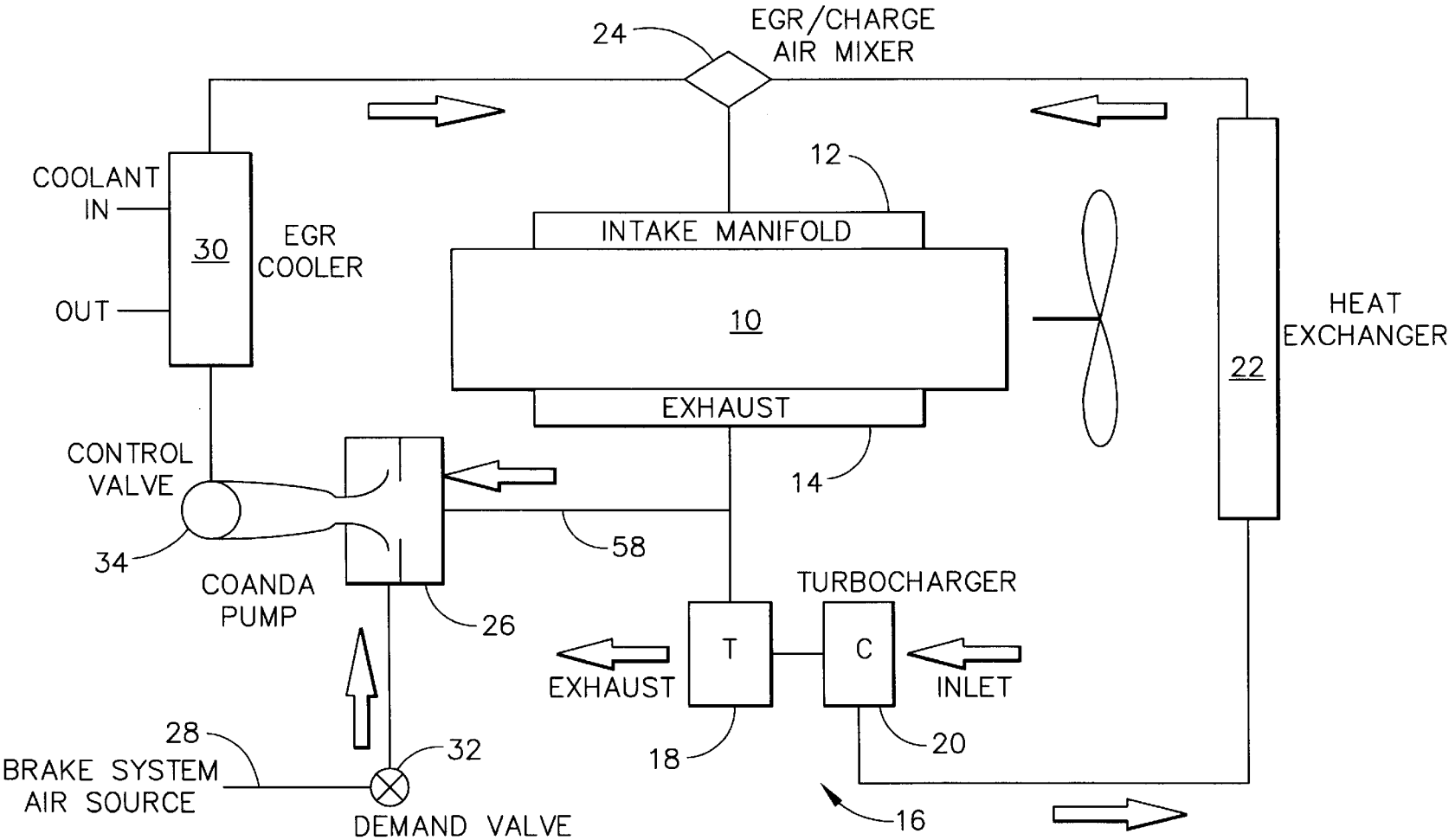
FIG. 1 is a schematic of the elements of a first embodiment of the present invention.

Referring to the drawings, FIG. 1 shows an internal combustion engine 10 with an intake manifold 12 and an exhaust manifold 14. For the embodiment shown in the drawings, a charge air boosting system is provided including a turbocharger 16 having a turbine housing 18 receiving exhaust gas from the exhaust manifold and a compressor housing 20 receiving fresh air through an inlet and providing pressurized charge air to a heat exchanger 22. The charge air is provided to the engine inlet manifold through a charge air mixer 24.

Exhaust gas to be recirculated is extracted from the exhaust manifold and provided to a fluidic pump 26, which for the embodiment disclosed in the drawings comprises a pump employing the Coanda effect. In alternative embodiments the fluidic pump employed comprises a Parietal jet-pump, pulse-jet aspirator or "Kylchap" pump, or single or multiple divergent annular slot jet-pump. High energy air is provided to the pump from a pressurized air source 28, which will be described in greater detail subsequently, for primary air flow. The recirculated gas flow exits the pump and is routed through an EGR cooler 30 for conditioning of the gas. Use of a separate EGR cooler in the embodiment of the present invention, as opposed to mixing of the recirculated exhaust upstream of the charge air heat exchanger, prevents fouling of the charge air cooler and precludes the need for material enhancement of the flow components to withstand the deleterious effects of the exhaust gas. This embodiment also allows optimization of the EGR cooler materials to withstand the corrosive and abrasive effects of the exhaust gas and sizing to match heat load requirements more closely.

The recirculated exhaust gas is entrained into the charge air flow through the charge air mixer for insertion into the intake manifold of the engine. Flow mixing is achieved through the use of a cyclonic flow arrangement, appropriate turbulators or other means to assure homogenous charge delivery to the engine. The mixer also incorporates an ejector arrangement, in alternative embodiments, to enhance pressure matching of the EGR and charge air flows.

Flow in the fluidic pump is controlled through a first controllable valve 32 on the primary air inlet and a second controllable valve 34 on the pump outlet. For the embodiment shown in FIG. 1, the first valve is a demand valve such as a pressure regulator. An electronically controllable valve is employed, in alternative embodiments, to provide active control of the fluidic pump for EGR flow, through an integrated engine control computer or similar system.

The second controllable valve adjusts the EGR flow from the pump output for engine demand and emissions control requirements. This valve is also implemented in various embodiments as an electronically controlled valve operated by the engine control computer.

Figure 2:
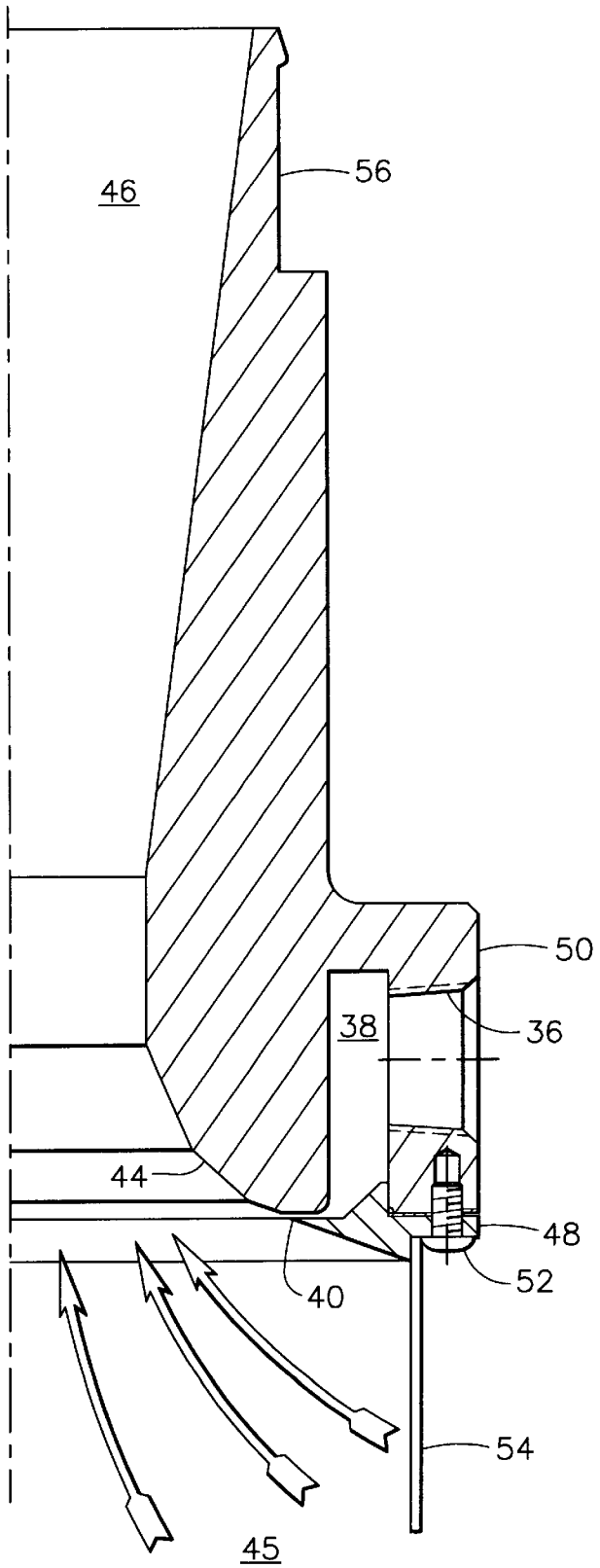
FIG. 2 is section elevation view of a Coanda pump concept suitable for use as an element of the invention.

FIG. 2 shows an embodiment of a fluidic pump for use in the present invention which employs the Coanda effect. Primary air from the pressurized air source enters the pump through port 36 and flows through annular chamber 38 to a narrow circumferential slot 40 for ejection into the pump throat 42. The thin, high speed primary air flow remains attached to the contour of throat surface 44, which in the embodiment shown employs a segmented transition, while flowing radially inwards. Use of a smooth machined transition or the dimensioning the segments of the transition is defined by flow performance requirements of the pump. The recirculated exhaust gas enters the pump through the pumped gas flow inlet 44 and is induced through the nozzle by viscous drag created by the energetic primary air flow on the throat surface. The resultant pressure amplification provides pressurized exhaust gas through the pump outlet 46 for recirculation.

For the pump shown in FIG. 2, a simple two piece construction is employed for ease of machining. A pump cap 48 including one surface of the primary air entrance slot is attached to a substantially cylindrical pump body 50. Bolts 52 sealingly engage the cap to the body and, for the embodiment shown, attach the inlet conduit 54 to the pump. A machined relief 56 on the outlet portion of the body provides attachment collar for the outlet conduit (not shown).

Connection of the EGR loop and the turbocharger to the exhaust manifold of the engine is shown in FIG. 1 as a simple "T" conduit 58. Alternative embodiments of the invention employ fixed or variable volumetric separators for segregating the EGR flow from the exhaust gas employed to drive the turbine of the turbocharger. Additional enhancements or alternatives include the bifurcation of the exhaust manifold providing EGR flow from a first portion of the engine cylinders and turbocharger exhaust flow from a second portion of the engine cylinders for balancing operation of the engine.

Figure 3:
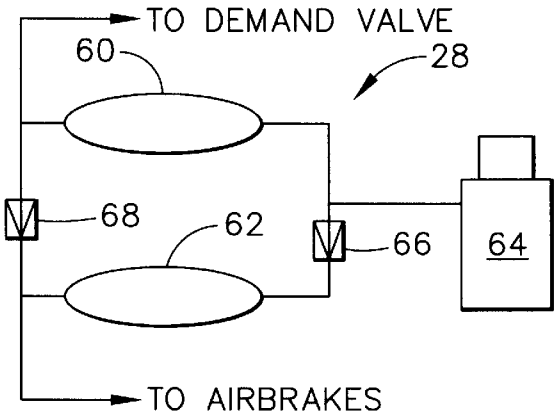
FIG. 3 is a schematic view of the elements of a pressurized air source for the fluidic pump integrated with the brake air system of a vehicle.

The pressurized air source, for the embodiments shown in FIG. 3, is incorporated in the air brake system for a vehicle such as a heavy truck. A pressure reservoir 60, which is placed in parallel with an existing brake pressure tank 62, is pressurized with air by a reciprocating positive displacement pump 64. At least one check valve 66 prevents inadvertent depressurization of the brake pressure tank by the EGR system in high demand or failure conditions. A parallel outlet with a second check valve 68 allows use of the EGR pressure reservoir as a supplemental brake air reservoir. Appropriate sizing of the positive displacement pump to accommodate both EGR pump primary air flow and brake needs is required or alternatively, use of a second pump for charging the EGR pressure reservoir. Use of rotary, radial, centrifugal or other alternative technology pumps for charging the EGR pressure reservoir may be employed.

Figure 4:
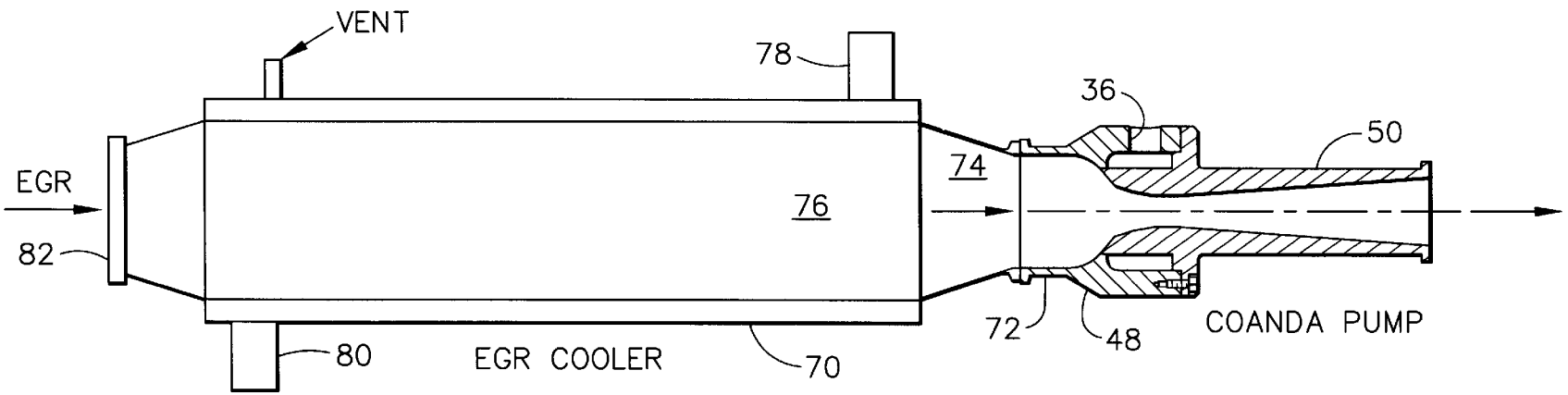
FIG. 4 is a side section view of an alternative embodiment of the Coanda pump incorporating an integral EGR cooler on the pumped gas flow inlet.

FIG. 4 shows an alternative embodiment of the fluidic pump employed in the present invention, which incorporates an EGR cooler 70 integral with the pumped fluid inlet of the fluidic pump. In this embodiment, the pump cap 48 is elongated to form an inlet flange 72. The EGR cooler incorporates a mating flange 74 on the cooler manifold 76 which is attached to the pump cap inlet flange using a V-band clamp (not shown). Alternative embodiments employ a bolted or welded flange, or a single piece corrosion resistant casting incorporating the pump intake and cooler manifold. The EGR cooler is provided with a coolant inlet 78 and a coolant outlet 80. Exhaust gas for recirculation enters the cooler through an inlet 82 which is attached to the exhaust manifold 58 of FIG. 1. The EGR Cooler 30 of FIG. 1 is eliminated in this embodiment. Integral attachment of the EGR cooler to the pump precludes the potential inducement of flow patterns in the pumped fluid inlet detrimental to pump efficiency which may result from vehicle design applications that place the cooler significantly upstream or downstream of the pump.

Having now described the invention in detail as required by the patent statutes, those skilled in the art will recognize modifications and substitutions to the specific embodiments disclosed herein. Such modifications and substitutions are within the scope and intent of the present invention as defined in the following claims.

What is claimed is:

1. An exhaust gas recirculation (EGR) system for an internal combustion engine comprising:

a fluidic pump having a primary air inlet and a pumped fluid inlet;

a pressure reservoir;

an outlet conduit connecting the pressure reservoir to the primary air inlet;

a controllable valve intermediate the pressure reservoir and the primary air inlet;

means for maintaining air pressure in the pressure reservoir;

means for connecting the pumped fluid inlet to an exhaust manifold of the internal combustion engine; and means for connecting an outlet of the fluidic pump to an intake manifold of the internal combustion engine.

2. An EGR system as defined in claim 1 wherein the controllable valve is a demand valve.

3. An EGR system as defined in claim 1 wherein the pressure reservoir comprises an air brake system pressure tank.

4. An EGR system as defined in claim 1 wherein the means for maintaining air pressure is a positive displacement pump.

5. An EGR system as defined in claim 3 wherein the pump outlet connecting means includes a second controllable valve.

6. An internal combustion engine charge air boosting system comprising:

a turbocharger having a turbine housing inlet connected to an exhaust manifold of the engine and a compressor housing having an air inlet and a charge air outlet;

a charge air cooler connected to the charge air outlet;

a charge air mixer connected to an output of the charge air cooler and to an intake manifold of the internal combustion engine;

a fluidic pump having a pumped fluid inlet connected to the exhaust manifold and a primary air inlet;

a pressure reservoir;

an outlet conduit connecting the pressure reservoir to the primary air inlet;

a controllable valve intermediate the pressure reservoir and the primary air inlet;

means for maintaining air pressure in the pressure reservoir; and means for connecting an outlet of the fluidic pump to the charge air mixer.

7. A charge air boosting system as defined in claim 6 wherein the controllable valve is a demand valve.

8. A charge air boosting system as defined in claim 6 wherein the pressure reservoir comprises an air brake system pressure tank.

9. A charge air boosting system as defined in claim 6 wherein the means for maintaining air pressure is a positive displacement pump.

10. A charge air boosting system as defined in claim 9 wherein the fluidic pump outlet connecting means includes a second controllable valve.

* * * * *